US006425533B1

(12) United States Patent
Shilton et al.

(10) Patent No.: US 6,425,533 B1
(45) Date of Patent: Jul. 30, 2002

(54) SPRAY GUN WITH COMMON CONTROL OF FLUID AND AIR VALVE

(75) Inventors: Mark Golder Shilton, Aston Clinton; Peter Miles, Little Chalfont; George Walter Robinson; Jeff Vincent Robinson, both of Spalding, all of (GB)

(73) Assignee: G Vincent Limited, Spalding (GB)

( * ) Notice: Subject to any disclaimer, the term of this patent is extended or adjusted under 35 U.S.C. 154(b) by 0 days.

(21) Appl. No.: 09/674,042

(22) PCT Filed: Feb. 25, 1999

(86) PCT No.: PCT/GB99/00150

§ 371 (c)(1),
(2), (4) Date: Oct. 23, 2000

(87) PCT Pub. No.: WO99/39832

PCT Pub. Date: Aug. 12, 1999

(30) Foreign Application Priority Data

Feb. 6, 1998 (EP) ..... 98300895

(51) Int. Cl.[7] ..... B05B 7/12

(52) U.S. Cl. ..... 239/290; 239/294; 239/296; 239/407; 239/413; 239/414; 239/415; 239/417.3; 239/417.5; 239/525; 239/526; 239/527; 239/528

(58) Field of Search ..... 239/290, 294, 239/296, 300, 398, 407, 413, 414, 415, 416.4, 416.5, 417.3, 417.5, 418, 423, 424, 525, 526, 527, 528

(56) References Cited

U.S. PATENT DOCUMENTS 2,880,940 A * 4/1959 Briggs
2,904,262 A * 9/1959 Peeps
3,670,961 A 6/1972 Tholome
3,791,579 A 2/1974 Cowan
4,955,544 A * 9/1990 Kopp
5,064,119 A * 11/1991 Mellette
5,078,322 A * 1/1992 Torntore
5,799,875 A * 9/1998 Weinstein et al.

FOREIGN PATENT DOCUMENTS

| | | |
|---|---|---|
| EP | 0 427 386 A2 | 5/1991 |
| FR | 2 357 310 | 2/1978 |
| FR | 2 522 991 | 9/1983 |
| WO | 90/10502 | 9/1990 |
| WO | 92/17279 | 10/1992 |
| WO | 94/13404 | 6/1994 |
| WO | 95/22409 | 8/1995 |

OTHER PUBLICATIONS

STAT–Attack information sheet, Amersham International plc, Amersham, U.K.

* cited by examiner

*Primary Examiner*—Robin O. Evans
(74) *Attorney, Agent, or Firm*—RatnerPrestia

(57) ABSTRACT

The spray gun has an air cap that generates a spray mixture of liquid and air. The air cap includes a fluid valve for controlling the delivery of liquid and a separate air valve in the body of the spray gun is provided for controlling delivery of air. A control mechanism assembly for both of the valves is located axially within a central bore extending substantially the length of the spray gun. The control mechanism is actuated by means of a cam and follower arrangement with the cam surface provided on the rear of a manually operable trigger. The fluid valve is fully adjustable separately from the air valve but the control mechanism assembly includes a common control member that is in engagement with the control mechanism and operates both the fluid and air valves. The arrangement of the air valve enables the surface area of the air passages leading from an ionizing source to the air cap to be minimized and unnecessary restrictions to be omitted so that ion recombination losses within the spray gun are significantly reduced.

13 Claims, 8 Drawing Sheets

SPRAY GUN WITH COMMON CONTROL OF FLUID AND AIR VALVE

Figure 1A:
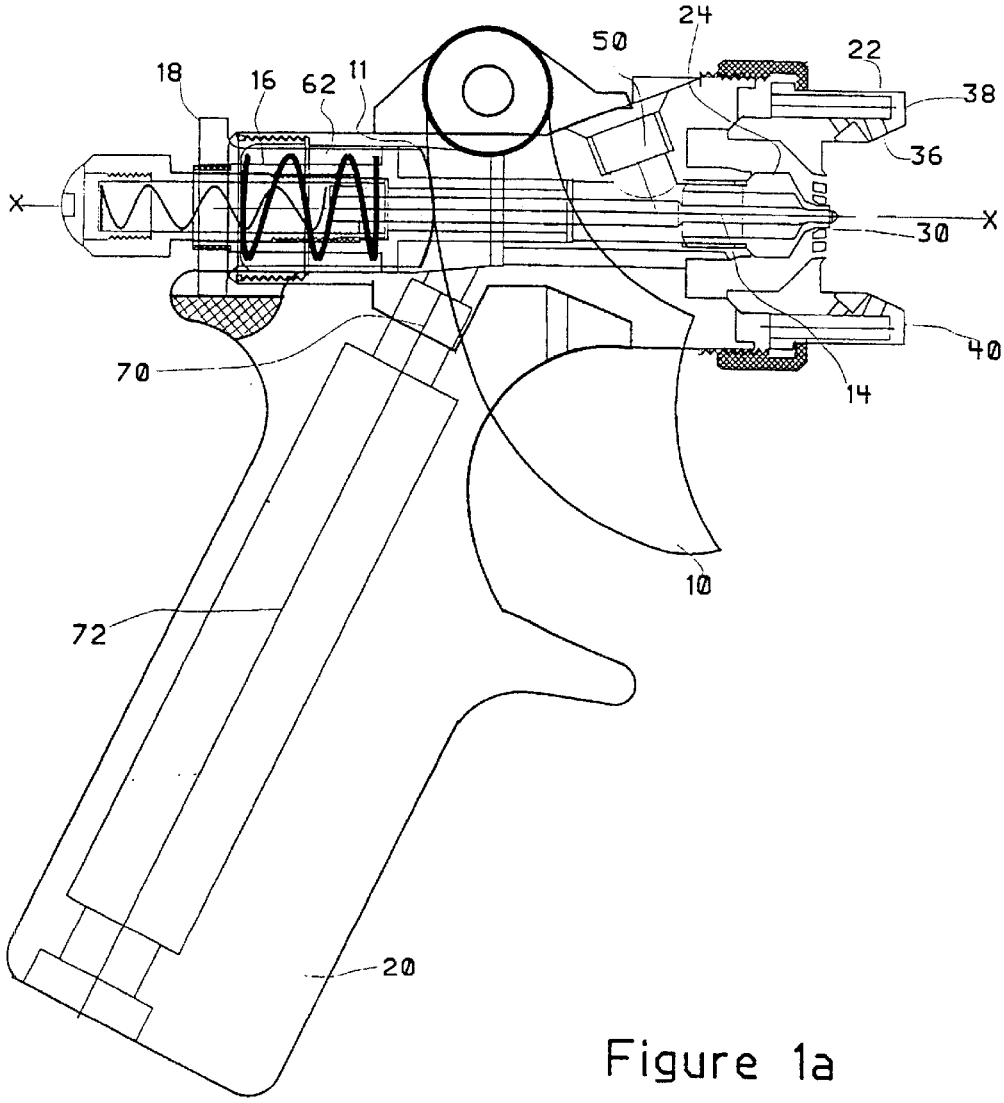

The present invention relates to a spray gun and in particular to a spray gun for use in spraying surface finishes and treatments. Particularly, but not exclusively, the invention is applicable to spray guns for the application of paint, and like material surface treatments, for example in the motor vehicle industry. The gun can be produced in three main forms, as a gravity fluid feed gun, a pressure fluid feed gun or an automatic oblique remotely-operated gun, all with single or multiple fluid feeds.

In the past, spray guns have used air input pressures of up to 620,000 Pa (ca. 90 psi) in order to achieve a head pressure (i.e. pressure at the air cap) of about 275,000 Pa (ca. 40 psi). High head pressure causes a cushion of air on the surface of the product being treated. This cushion forms a barrier that prevents the sprayed material reaching the surface and causes some of the sprayed material to bounce back and be displaced sideways by the following airflow and for it to be lost in the surrounding air.

Accordingly, this type of spray gun is very inefficient. Paint transfer efficiencies of greater than 35% are unusual, and the waste of paint material produces unacceptable emissions. of volatile organic compounds. In addition a solid residue can remain, this can be floating in the air for some time and may be highly toxic. These components are damaging to health. To overcome these problems it is necessary to reduce the air pressure and air volume used in such guns.

If the air pressure is reduced on a spray gun designed for high pressure use, the turbulence and restrictions in internal air passages, and in the air cap, cause a loss of air speed and a reduction in air volume. The result is low paint transfer rates, poor atomisation and an inferior paint finish, however transfer efficiency improves.

Existing high pressure spray guns have been modified to operate at low pressures, but the complexity of the designs and the intricate interconnecting drilled passages do not permit good air flow. In an effort to overcome the poor performance, increased air cap ring gaps are used, resulting in a substantial increase in air consumption. This type of spray gun has become known as the HVLP (high volume low pressure) type of spray gun.

More specifically, in prior spray guns and in the HVLP type of spray gun the means for actuating the valves which control and regulate the flow of liquid materials to be sprayed, and the pressurised air supply, and the interaction of these controls with the airflow passages to the spray nozzle, and the disposition of the nozzle relative to the remainder of the apparatus, leave considerable shortcomings. For example, it is commonplace that the stem of the needle valve with its associated compression spring and housing pass right across and through the path of the main air flow leading to a significant restriction in flow, air turbulence and energy loss. For example, as shown in WO 95/22409.

Likewise, in order to provide a convenient means for actuating the stem of the air flow valve and the fluid needle valve, the main spray nozzle of the apparatus is mounted on a forward projection of the apparatus so as to leave a free space to accommodate the arc of movement of the control valve trigger.

Moreover, where the same trigger operates both the liquid and air control valves directly, the progressive adjustment of the fluid control from on to off can influence operating characteristics of the air control valve which can be restricted in certain operating conditions. For example, this can occur when the liquid control valve has been manually adjusted to a point of nil flow which affects the ability of the trigger to operate both valves simultaneously through the full range of movement. Spray guns having a fluid flow restrictor valve or screw allow a full range of movement, however the control of fluid flow is no longer progressive.

The process of atomising fluid droplets in a spray gun is known to generate significant static electricity that becomes associated with the atomised spray droplets. Static charge on the droplets causes the spray to disperse and broaden due to repulsive forces. Thus, the work surface becomes progressively more charged during spraying. This causes strong electric field gradients to build up and repel incoming spray droplets, causing progressive reduction in transfer efficiency. Where charge persists during drying, airborne dust particles can be attracted onto the paint causing significant variations in the visual quality of the coated surface.

Static electrification during spraying is a problem which has persisted for many years in the painting industry. There have been several attempts to solve the problem but none have proved to be fully satisfactory. Attempted methods have involved providing earthed or conducting connections between the work and ground or between the work and the spray gun, or they have intentionally charged the work surface in an attempt to attract spray droplets (this is known as electrostatic spraying and is employed as a method of painting complex shapes without moving the spray equipment or work). While such devices may have significant beneficial effect on transfer efficiency, they will not apply static-free surface coatings.

Although some attempts have been made to incorporate a radioactive ioniser into the high pressure feed line of conventional high pressure spray guns in an attempt to neutralise static charges, due to poor design and unsuitable operating conditions,associated with high pressure spray guns and due to inappropriate design and positioning of conventional radioactive ionising cartridges, these attempts produced negligible benefits.

One object of the present invention is to provide apparatus for spraying a fluid such as paint or other surface treatment material, using a propellant, which may optionally be ionised, offering improvements in relation to one or more of the deficiencies of conventional spray guns described above.

Accordingly the present invention provides a spray gun having a cap with a spray nozzle; a propellant valve for controlling delivery of a propellant along a plurality of propellant passages to the spray nozzle; one or more fluid valves for controlling delivery of one or more fluids to the spray nozzle; and a common activation member provided on the central axis of the spray gun adapted to control both the propellant valve and the one or more fluid valves, wherein the plurality of propellant passages from the propellant inlet to the cap are substantially linear.

The propellant may optionally be ionised to reduce static and hence improve the efficiency of deposition of the fluid. Also, the spray gun may be adapted for either manual use incorporating a manually operable trigger, or may be suitably modified for use in automatic or robotic systems for example in-line systems in manufacturing plants.

The spray gun may optionally include an ioniser connected anywhere in the propellant passages downstream from the propellant inlet. With the spray gun of the present invention the propellant passages from the propellant valve to the nozzle may be short in length and substantially linear. In this way the ion density in the propellant flow may be maintained and the extent of ion losses through recombination at the walls of the propellant passages minimised.

The "ioniser" is suitably chosen from a radioactive source, an X-ray ioniser or a high voltage corona discharge. For manual or hand-held spray guns the ioniser is ideally compact and lightweight to give the operator maximum convenience and ease of movement. For such manual spray guns the ioniser is preferably located within the handle of the spray gun, and the ioniser is preferably a radioactive source, and most preferably an alpha emitter especially the radioisotope polonium-210 (Po-210). The radioactive alpha emitter is preferably in the form of a sealed foil source. For automatic or robotic spray guns size and weight considerations are less important to the operation of the invention hence even quite bulky ionisers may be used, but where compactness is desirable radioactive sources are preferred.

The uni-axial design of the common activation member permits the use of a needle valve aligned along the central axis of the gun. Furthermore, one or more propellant passages are preferably located below a horizontal plane passing through the central axis of the gun. In this way the flow of propellant to the cap is unimpeded by the needle valve, unlike prior art designs. This provides an unrestricted, short path from the propellant inlet to the nozzle which minimises turbulence and energy loss and, where ionised propellant is being used, ionisation at the delivery point can be maximised.

Reference to the one or more passages being "substantially linear" is intended as reference to the passages having a minimum number of deviations from linearity, i.e. bends in the propellant passages up to the cap. Preferably the number of deviations from linearity is zero or one, most preferably it is zero whereby impedance of the flow of propellant is minimised which in turn minimises turbulence of propellant flow to the cap. The propellant valve is designed and positioned so that it provides a substantially unrestricted, short, and substantially linear path for the propellant from the propellant inlet to the spray nozzle in the open position.

Thus, preferably, the ratio of inlet pressure to air cap pressure is less than 2, more preferably less than 1.5 and ideally 1.3.

In the fully open and in the partly open (transient) position the flow of propellant is guided by the shape of the valve housing into the one or more passages to minimise turbulence and energy loss. The propellant valve may consist of a piston and valve housing recess which are both tapered so that as soon as the valve mechanism is actuated the entire periphery of the propellant inlet is opened, even in the transient, partly open position, giving rise to progressive flow change without significant turbulence and energy loss.

The fluid flow control includes a needle adjustment housing which permits a progressive adjustment from zero flow to full flow without restricting the propellant flow.

Furthermore, the fluid inlet may be located immediately adjacent to the spray nozzle so that viscous fluids such as high solids paint may be sprayed using the gun.

In a further aspect the present invention provides a spray gun having a spray nozzle and a propellant valve at a propellant inlet for controlling delivery of propellant along one or more passages to the spray nozzle wherein an ioniser for ionising propellant passing through the ioniser is provided adjacent the propellant inlet.

Figure 1B:
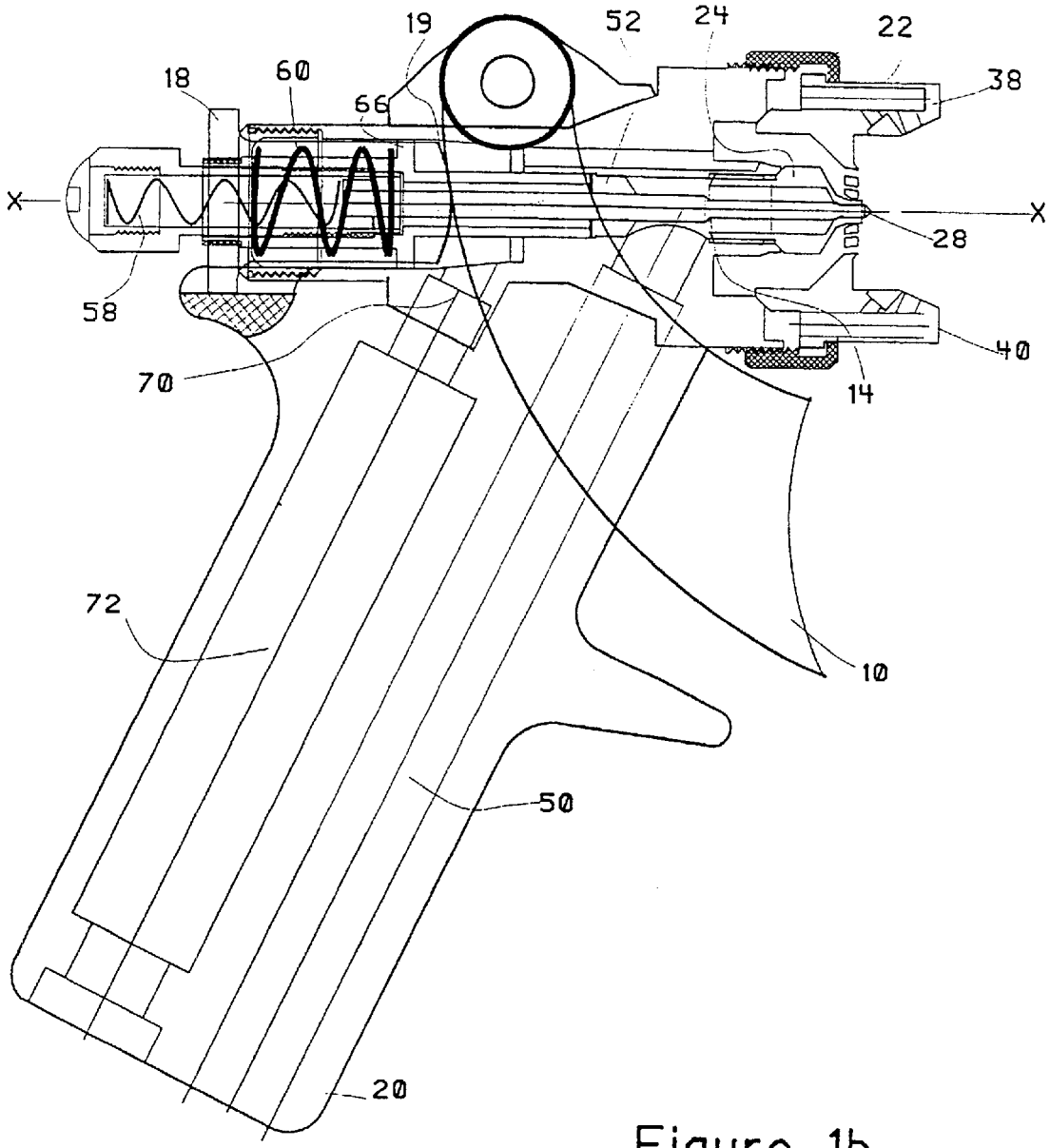
Figure 2:
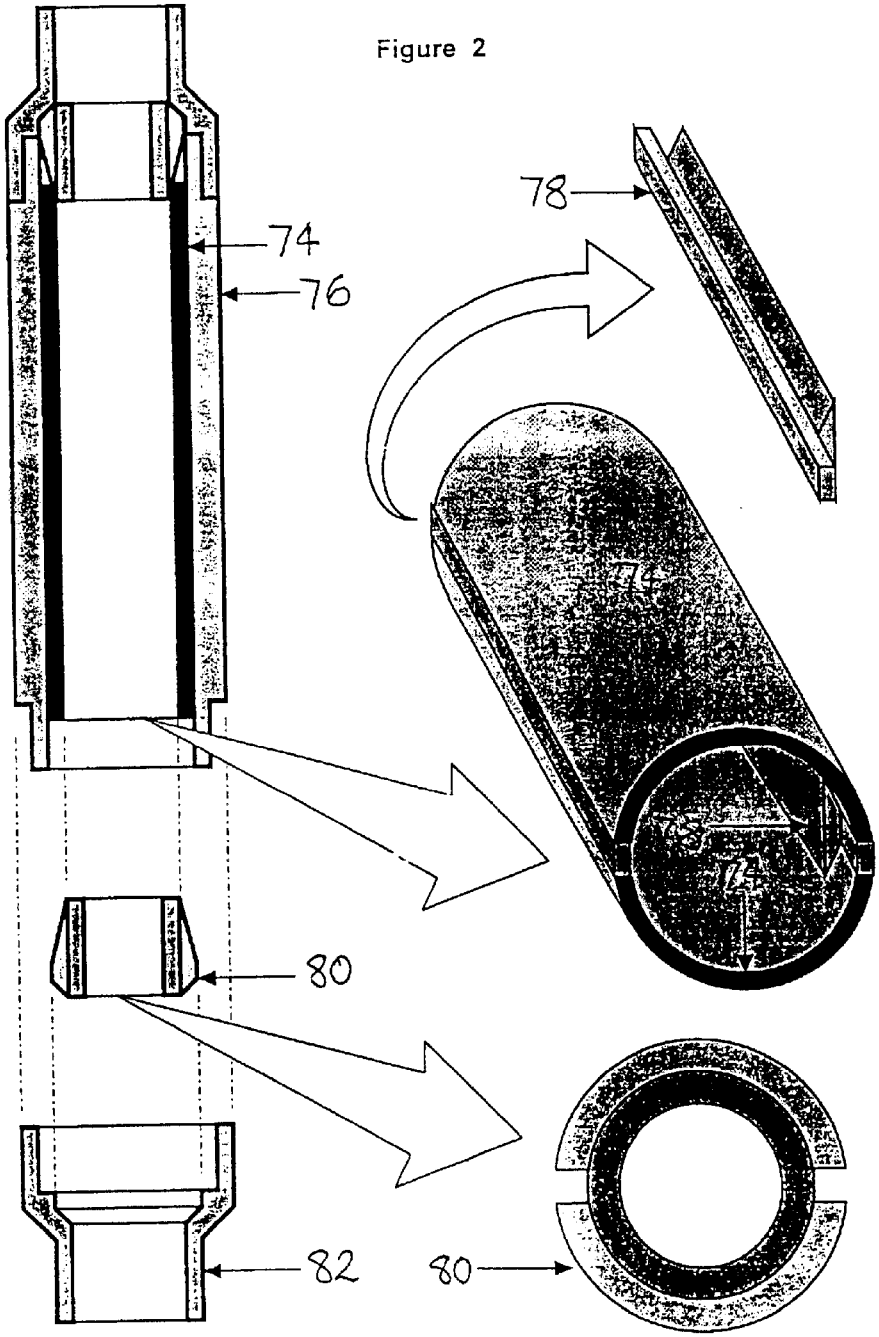

Embodiments of the present invention will now be described by way of example with reference to the accompanying drawings, in which:

FIGS. 1*a* and 1*b* are drawings of a preferred embodiment of the present invention where the propellant is compressed air and the fluid to be sprayed is paint and the spray gun includes a radioactive ioniser in a gravity feed and in a pressure feed form respectively;

FIG. 2 is a drawing of the radioactive static ioniser for use with the spray gun of FIGS. 1*a* and 1*b;*

Figure 3A:
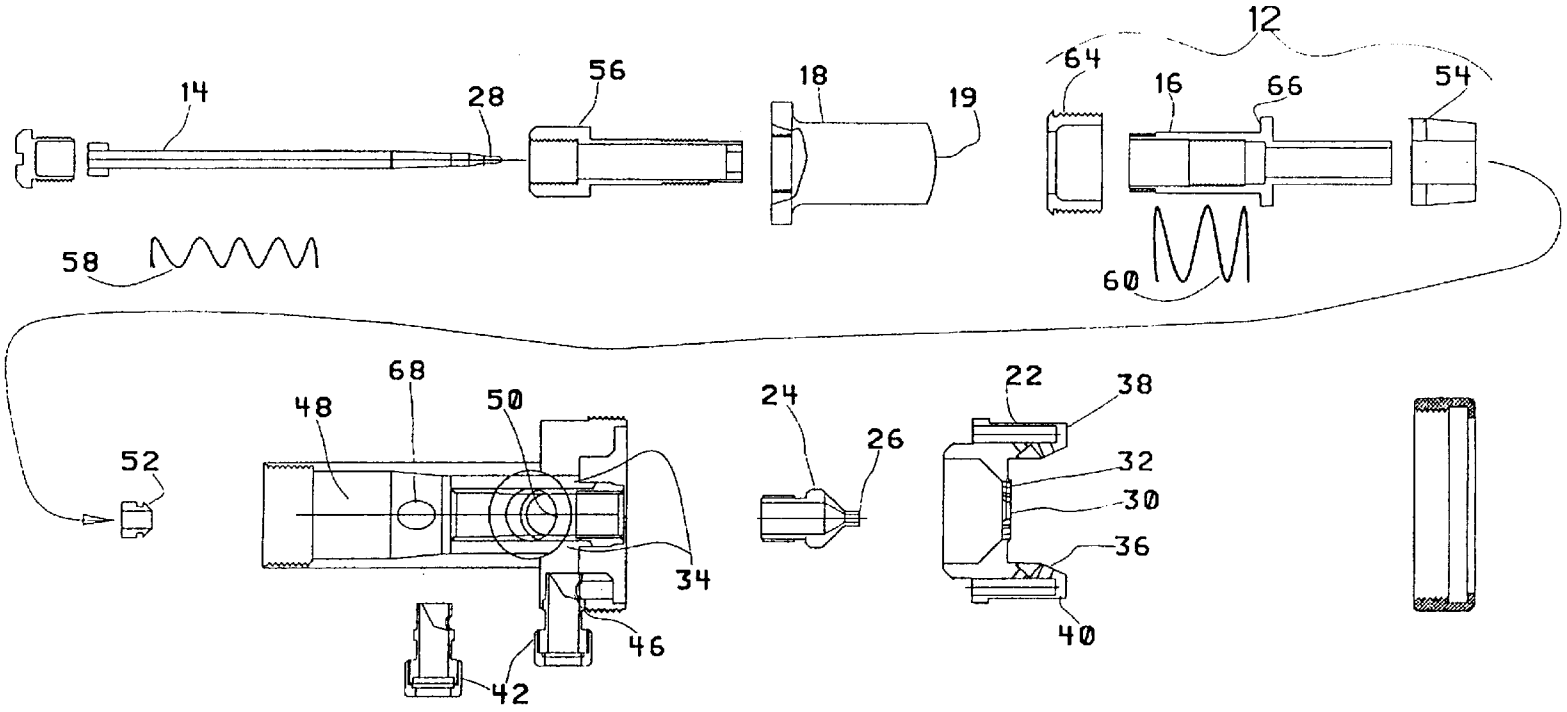

FIG. 3*a* is an exploded drawing showing details of the air control valve and fluid control valve mechanisms of the spray gun of FIGS. 1*a* and 1*b;*

Figure 3C:
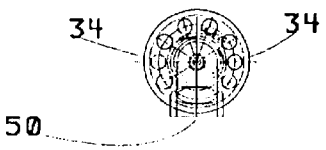
Figure 3B:
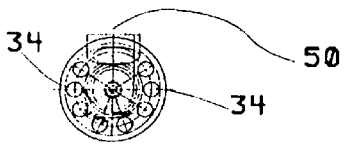
Figure 4A:
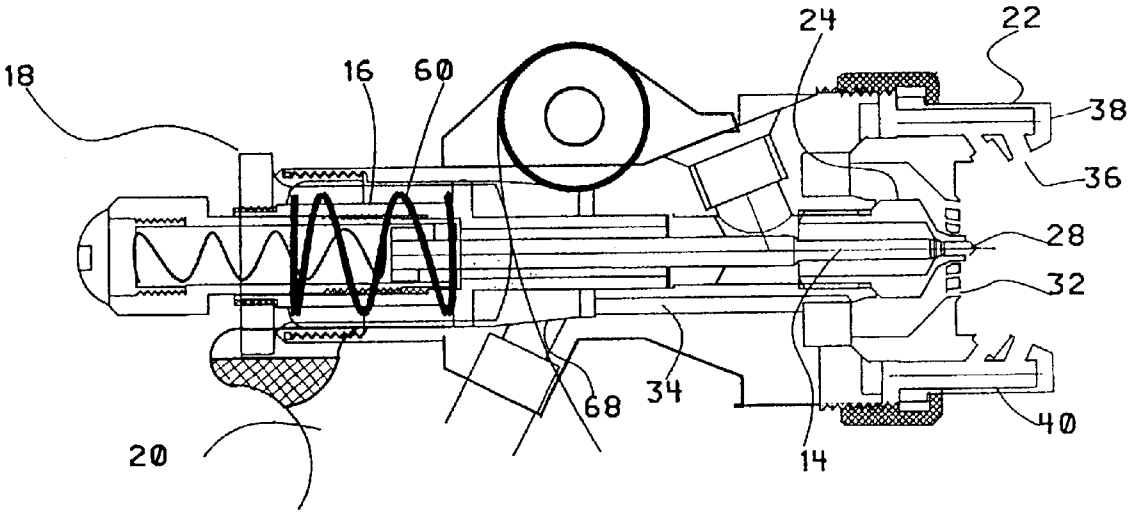
Figure 4B:
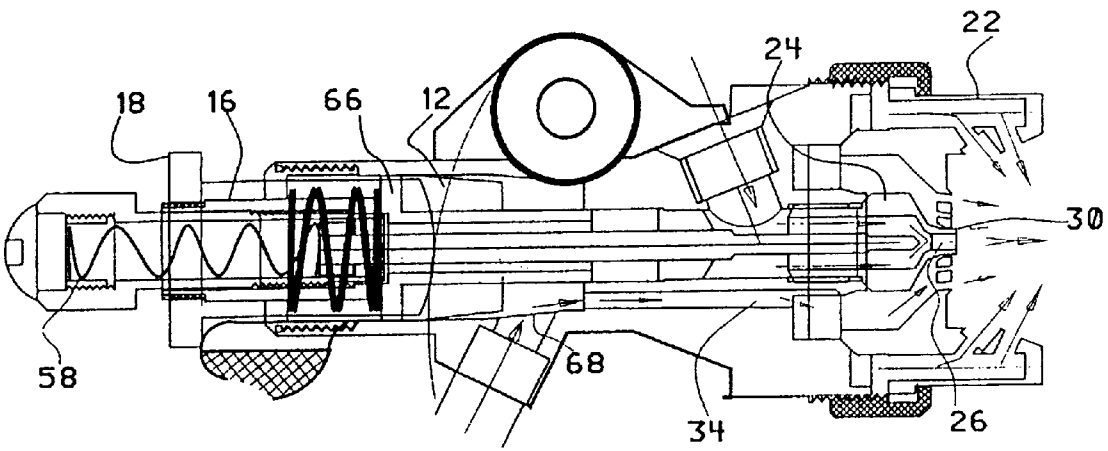
Figure 5A:
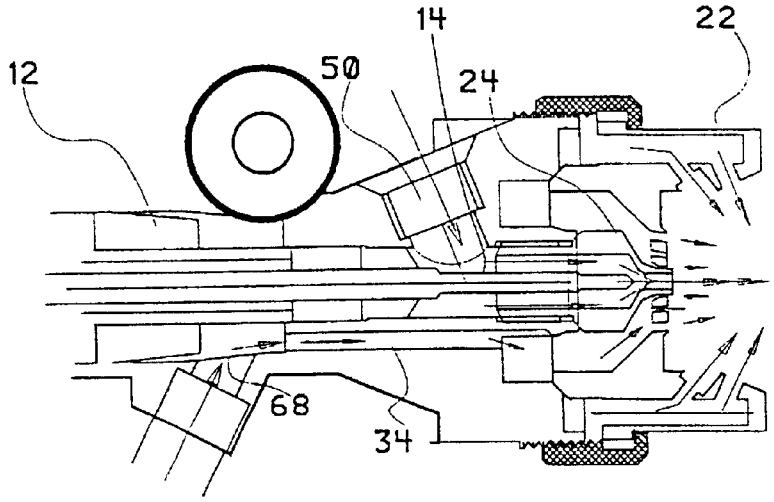
Figure 6B:
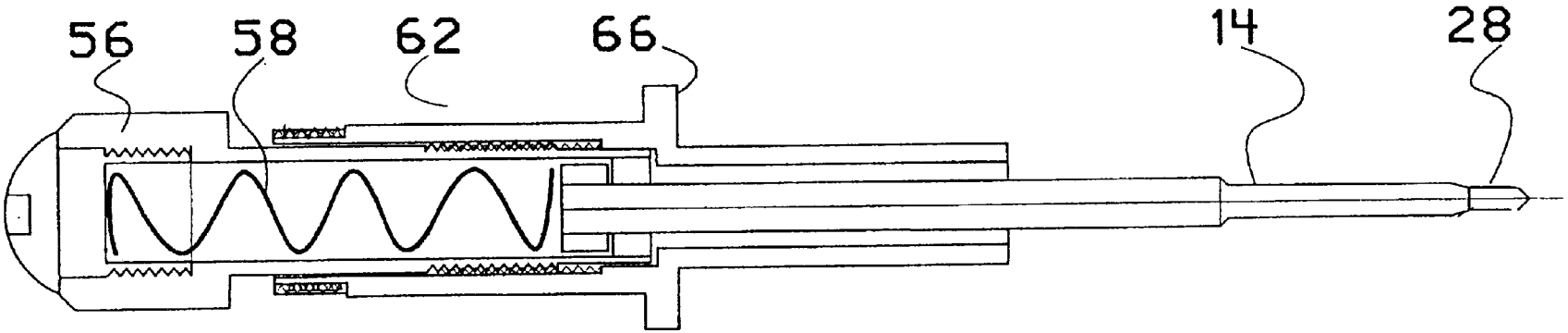
Figure 6A:
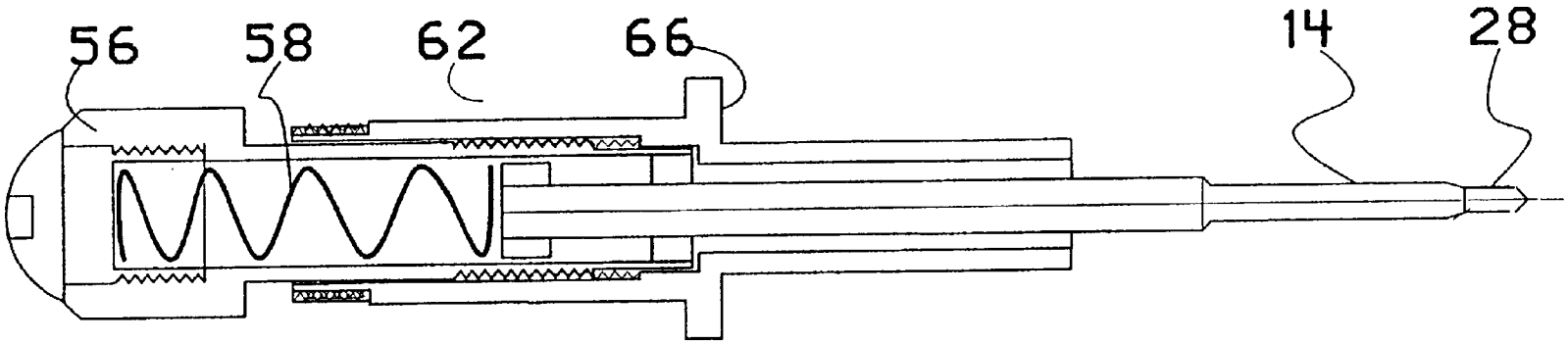
Figure 7A:
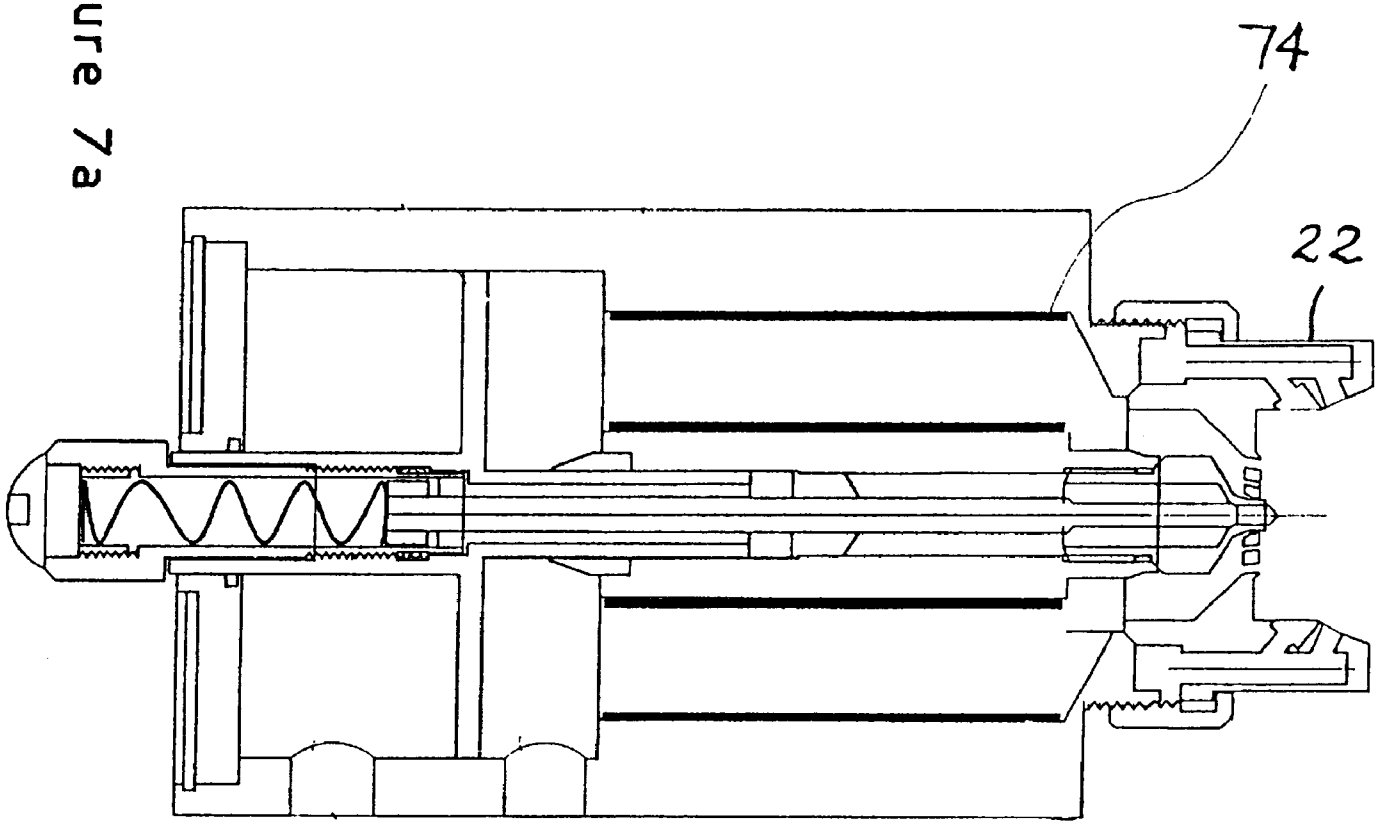

FIGS. 3*b* and 3*c* are vertical cross-sections through the main body and valve assembly of the spray gun of FIGS. 1*a* and 1*b* respectively;

FIGS. 4*a* and 4*b* are drawings showing details of the air cap and needle valve mechanism of the spray gun of FIG. 1*a,* in the closed and open positions respectively;

FIGS. 5*a,* 5*b* and 5*c* are enlargements of the upper portion of the spray gun showing the details of the air inlet valve piston and housing in the open, closed and transient positions respectively;

FIGS. 6*a* and 6*b* show details of the needle adjustment housing assembly in compressed and extended positions respectively; and FIG. 7 is a drawing of a spray gun in accordance with the present invention suitable for automated use.

In FIGS. 1*a* and 1*b,* an ionizing paint spray gun assembly is shown. The spray gun generally comprises of a manually operated trigger 10 which operates an air control piston valve 12 and a fluid control needle valve 14 simultaneously without restricting the operation of either regardless of the adjustment of the other.

The fluid control needle valve 14, and the air control piston valve 12 operate on a common central axis X. The fluid control needle valve 14 passes through the air control piston valve 12 with the stem 16 of the air valve engaging the trigger 10 via operating sleeve 18 which is connected to the rear of the piston valve stem 16. The operating sleeve 18 acts as a common activation member for both the piston valve 12 and the needle valve 14, as will be described in greater detail below.

The spray gun consists of a handle 20, a valve control section and an air cap 22 at the forward end of the valve control section. The air cap 22 is generally conventional in design and houses a fluid nozzle 24 having a central aperture 26 through which the liquid to be sprayed, such as paint, is delivered. The central aperture 26 is opened and closed by the tip 28 of the needle valve 14 located within the fluid nozzle 24. The air cap 22 further includes a central air outlet aperture through which the fluid nozzle 24 protrudes creating an air outlet annulus 30 surrounding the fluid outlet aperture 26. Additionally, a plurality of openings 32 is arranged about the central fluid aperture 26. The air outlet annulus 30 and the plurality of openings 32 are in communication with a series of air passages 34 that extend between the air valve 12 and the air cap 22. The air passages 34 may be more clearly seen in FIGS. 3*b,* 3*c* and 4*b* where the flow of air from the air valve 12 to the air outlet annulus 30 and the plurality of openings 32 is indicated by arrows. The air passages 34 are also in communication with jet holes 36 provided in opposing upper and lower horns 38, 40 that define a spray pattern cavity immediately beyond the central aperture 26. During use, the air jets from the jet holes 36 cause the stream of fluid emerging from the central aperture 26 and the stream of air emerging from air outlet annulus 30 and the openings 32 to be shaped within the spray cavity to form an elliptical shape in cross-section.

A fan pattern control valve 42 (see FIG. 3*a*) controls the volume of air passing through to the jets 36. Rotation of control valve 42 controls the flow of air from passages 34 through port 46 from nil flow to full flow.

Behind the air cap 22 is a central bore 48 aligned and co-axial with the central axis X of the spray gun. The fluid nozzle 24 is screwed in to the central bore 48 which is in communication with a fluid passage 50 via which passage fluid to be sprayed from the gun is delivered. As shown in FIGS. 1*a* and 1*b,* the fluid passage 50 is preferably located above in the gravity feed gun and below in the pressure feed gun the central axis X of the bore 48 and adjacent to the fluid nozzle 24 and air cap 22. The needle valve 14 is co-axially located within the bore 48 and is capable of axial movement to insert and remove the needle tip 28 from the central aperture 26. Behind the junction of the bore 48 with the fluid passage 50, a seal 52 is provided about the needle valve. The seal 52 preferably consists of a PTFE seal and o-ring combination and acts to prevent back-flow of fluid along the bore 48.

The needle valve 14 extends backwards (to the left in the Figures) beyond the seal 52 through a valve piston 54 and ends within the bore of an adjustment housing 56. The needle valve 14 is biased by means of a needle spring 58 that is positioned within the adjustment housing 56. The adjustment housing 56 is threaded so that the position of the needle valve 14 can be adjusted to provide control of the range of fluid flow through the central aperture 26 and to permit the needle tip 28 to remain on its seat when only air is required. Thus, even though a common activation member 18 is used for controlling actuation of the valves, separate control of the amount of fluid delivered to the nozzle from nil to a full amount is possible without interference with the air flow to the nozzle.

The adjustment housing 56 is adjusted by screwing in or out of the stem 16 of the piston valve 12 and so movement of the piston valve 12 moves the needle adjustment housing 56 by the same amount. Thus, as shown in FIGS. 4*a* and 4*b,* as the housing 56 is moved backwards (towards the left in the Figures) the needle tip 28 is moved out of the central aperture 26 thereby permitting fluid to flow through the nozzle 24 and out through the central aperture 26. In FIG. 4*a,* on the other hand, the housing 56 is shown at its most forward position (with the trigger 10 inactive), with the needle tip 28 closing the central aperture 26.

At the rear of the piston valve 12 is the stem 16 which is connected to the operating sleeve 18 which is slideable within the main body of the gun. The sleeve or shoe 18 provides a forward facing abutment surface 19 for abutment with the trigger 10. In addition, an air control spring 60 is mounted in a recess 62 in the main body. One end of the spring engages an end cap 64 fitted within the main body whilst the other end of the spring 60 engages a shoulder 66 on piston valve 12. The air control spring 60, which is under compression in its rest state, acts as a biasing member to maintain and return the piston valve to its seat. As needle adjustment housing 56 is screwed into the stem 16 of piston valve 12, any movement of piston valve 12 results in the same movement to needle adjustment housing 56.

Figure 5B:
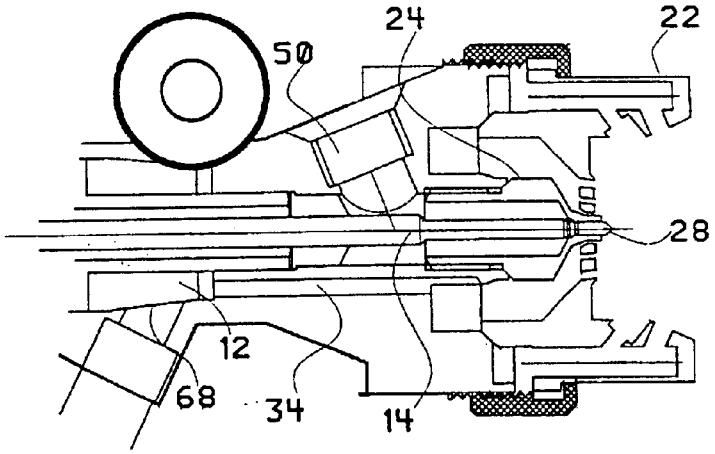
Figure 5C:
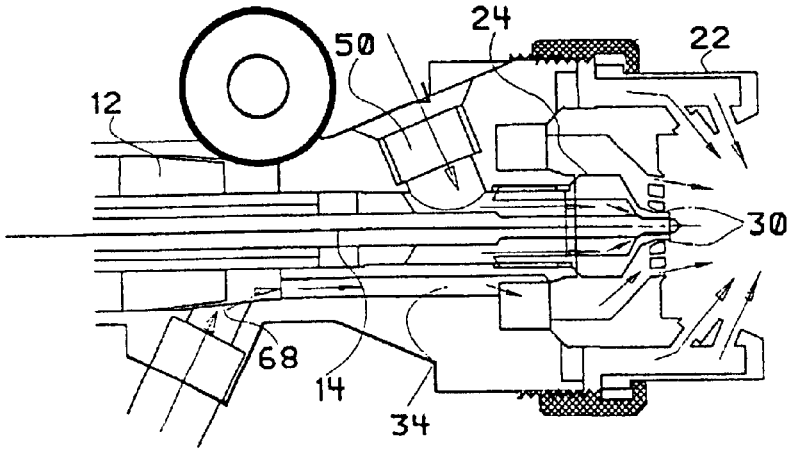

As shown in the Figures, the bore 48 has a greater diameter towards the rear of the spray gun and it is within this larger section of the bore that the piston valve 12 and stem 16 axially moves. Thus, piston valve 12 and stem 16 are different areas of the same component. The forward region of the larger diameter section of the bore 48 includes an air junction 68 controlled by the piston valve 12 affording communication between an air passage 70 located in the handle 20 of the spray gun and the air passages 34. In the open position; the air valve 12, via junction 68, affords a substantially unrestricted, low turbulence path from the junction 68 to the air cap 22. The air passages 34 extend substantially parallel to the central axis X of the spray gun between the rearward, larger section of the bore 48, downstream of the seal 52, and the air cap 22 and are located radially outwardly from and in a circle concentrically about the forward, narrow section of the bore with at least one passage positioned below a horizontal plane passing through the central axis X. Ideally, the air passages 34 are axiosymmetric about the central axis X and the needle valve 14. The air passages 34 are substantially linear, i.e. for the majority of their length, the passages are straight and do not include turns or corners. Ideally, as shown in FIGS. 1, 4 and 5, the junction 68 is positioned near the forward end of the larger section of the bore, adjacent to the opening with the air passages 34.

The air valve 12 includes a tapered valve piston 54 that fits into a tapered valve housing recess in the bore 48. The air inlet is located forward of the operating sleeve 18 so that actuation of the trigger 10 caused linear movement of the valve piston towards the rear of the spray gun. With this design when the air valve 12 is initially actuated to open, the full periphery of the gas inlet is immediately unimpeded and able to pass air with further movement of the valve piston increasing the clearance above the air inlet. This allows a progressive increase in air flow with significantly reduced turbulence.

The operating sleeve 18 engages with stem 16 of the piston valve 12 whilst the face 19 of the operating sleeve engages with a cam surface 11 on the trigger 10, the face 19 of the operating sleeve acting as a cam follower. In its rest position, piston valve 12 closes the junction 68 with the air passage 70. As the trigger 10 is manually operated and thereby pulled backwards (towards the left in the Figures), the face 19 of the operating sleeve follows the cam surface 11 on the trigger and causes the piston valve 12 to slide backwards within the larger bore of the main body. This in turn opens both the central aperture 26 and the junction 68 substantially simultaneously. Thus, the trigger 10 activates a single control member in the form of the operating sleeve to control the actuation of and the opening and closing of both the fluid and air valves.

The arrangement described above enables the straight unobstructed large diameter air passage 70 in the handle 20 of the spray gun to communicate directly with the air valve 12. The arrangement also enables the air passages 34 that extend from the air valve 12 to the air cap 22 to be relatively short and straight and also affords substantially unobstructed communication between the short, large diameter fluid passage 50 with the fluid nozzle 24. This arrangement minimises turbulence of air within the passages and in turn minimises the pressure difference between the air inlet and the..air outlet annulus 30. This also means that less air need be used but with; improved performance. This is particularly important where ionised air is used because the greater the amount of air the lower the ionisation density. Also, the lower the turbulence and the shorter the journey from the air inlet to the nozzle the lower the ionisation losses through recombination at the passage walls. Thus, unlike conventional spray guns that require an inlet pressure of 40 psi (275,000 Pa) to achieve an outlet pressure of 10 psi (6,9000 Pa), with the spray gun described above an inlet pressure of only 13 psi (90,000 Pa) is required to ensure the outlet pressure of 10 psi (6,9000 Pa).

A radioactive air ioniser 72 is incorporated into the handle 20 of the spray gun to generate an ionised air stream that neutralises static charges produced by the atomisation process. Of course alternative non-radioactive ionisers may also be employed.

FIG. 2 shows the construction of a preferred embodiment of a radioactive air ioniser. The ioniser comprises two rectangular radioactive sources 74 each of which are formed into the shape of a gutter and located in a metal cartridge 76 using two side locators 78 and two end location sleeves 80. In an alternative preferred embodiment the two side locators 78 and the metal cartridge 76 can be formed, into a single piece aluminium extrusion into which the sources are slid from one end before the end location sleeves 80 are connected. The radioactive sources 74 contain the radioisotope polonium-210 and are in the form of sealed metal foils that emit alpha particles towards the central axis of the cartridge. The two end location sleeves 80 are pressed into the cartridge 76 to firmly secure the sources 74 in position using two end plugs 82 which are fixed into position using an adhesive or other suitable fixing means.

The assembled cartridge is located within the handle of the ionising paint spray gun at a position close to the air control valve 12, as shown in FIG. 1. The handle 20 is preferably moulded from a plastics material and is made in two halves so that the halves may be bonded together about the ioniser 72 to hold the ioniser securely in place. As the ioniser 72 is symmetrical it can be placed either way round in the handle 20 of the paint spray gun.

When compressed air is fed into the cartridge 76 from the compressed air feed line and the air control valve 12 is activated, air flows through the cartridge 76 and ionisation from the sources 74 is swept into the paint spray gun. In a preferred embodiment the internal diameter of the cartridge 76 is 15 mm, the internal diameter of the end location sleeves 80 is 11 mm, the internal length of the cartridge cavity is 74 mm and the mean internal diameter of the radioactive sources after they have been loaded is approximately 14 mm. Cartridge dimensions are carefully chosen to optimise the ionisation production rate having due regard for the internal air pressure inside the device and the air flow characteristics. Ideally, the internal design pressure for the paint spray gun is 90,000 Pa (ca. 13 psi) above atmospheric in which case the static ioniser is designed for optimal performance at 90,000 Pa (ca. 13 psi).

To optimise the performance of static ionisers for use in spray guns, the cartridge dimensions, the air flow characteristics and the air pressure are selected to cause the ionisation density to be greatest along the central axis of the cartridge chamber. The cartridge 76 is profiled to reduce air turbulence and preferably has an internal diameter slightly greater than the diameters of the inlet and outlet plugs 82. As the sources 74 are located on the inner walls of the cartridge 76, the greatest density of ions is found along the centre of the cartridge and with turbulence of the air flow reduced to a minimum, the increased density of ions in the core of the air flow can be maintained as the air flows through to the spray gun to the air cap.

For a manually operable spray gun, the ioniser is preferably located in the handle of the device as described above. For an automatic spray gun the ioniser can be located at any point in the propellant transfer passages, and may for example be conveniently sited in the transfer drillings as shown in FIG. 7.

With the spray gun described above, the internal passageways within the paint spray gun are designed to provide minimum surface area and without unnecessary constrictions or tight bends. In the preferred embodiment shown in FIGS. 1, 4 and 5 these are 50% less than in conventional spray guns. This minimises turbulence, energy loss and mixing of the ionised air stream which helps to reduce ion recombination losses which occurs predominantly on the internal walls of the spray gun. Notably, the above described spray gun affords a ratio of less than 2 of inlet pressure to air cap pressure. Preferably the ratio is less than 1.5 and most preferably 1.3. Accordingly, an ionising paint spray gun is provided in which the design parameters of the static ioniser and the spray gun are carefully matched to enable both ioniser and the spray gun to function at optimum efficiency. The combination of LVLP spray gun design with radioactive static ioniser technology provides a unique and effective solution to static electrification problems which have hitherto been encountered in paint spraying applications and for which other attempts to provide a solution have failed whilst also providing a device with optimal fluid transfer efficiency. In a preferred design the air cap to air valve trigger air passage length is 75% less than for conventional designs. Also, the total air passage length is approximately 40% less than for the same conventional designs. This feature is important as it reduces the time of flight for the ions in the air flow. Furthermore, the input air pressure can be 75% lower than the average for conventional designs and the air volume required can be approximately 50% lower than the average for the same conventional designs. This feature is important because. it affords less turbulent mixing in the air flow i.e. minimises wall collisions and so increases ion concentration. Finally, with the preferred design depression at the fluid nozzle is approximately 30% greater than for conventional HVLP designs which provides good atomisation of viscous, high solids paint materials.

The effects of the above design features are to reduce the compressed air volume required, to reduce the pressure of compressed air, to reduce energy losses through the gun, to improve exit air speed, to increase depression at the fluid nozzle to reduce resistance to fluid flow through the gun and to eliminate static electrification due to atomisation at the spray nozzle.

Although the spray gun has been described with reference to a mixture of fluid and optionally ionised propellant being sprayed, due to the unique needle adjustment control 56 the spray gun may additionally be used to spray only ionised propellant (such as air) for the purposes of deionising a surface before application of the fluid such as paint.

Reference is generally made herein to air but it will be apparent that any propellant would be suitable. Reference to the term "propellant" is intended as reference to any liquid or gas or mixtures thereof such as a gas/vapour mixture, suitably chosen to have low viscosity properties. The propellant is preferably either a gas (such as nitrogen, carbon dioxide, helium or argon) or mixture of gases such as air. The propellant functions to transport and disperse the fluid to be delivered. The movement of the propellant may be achieved with or without mechanical means. Thus the propellant will be under pressure, either by being locally compressed or, when the propellant is a gas or gas mixture it may be supplied from compressed gas cylinders. Alternatively, the propellant may be pressurised by means of intrinsic pressure such as that generated by a volatile substance at or near its' boiling point in a confined space. Preferably the propellant is a pressurised gas or gas mixture such as compressed air.

The "fluid" to be delivered by the spray gun can be a liquid such as a solvent or solvent mixture, a solution of one or more solutes, or an emulsion which may be either liquid-liquid, liquid-solid or liquid-gas; or gas/vapour or gas/solid mixtures such as dispersions of finely-divided powders. Examples of suitable fluids are paints or pigments as solutions or suspensions in either aqueous or organic media; adhesives; lacquers; plastics (eg. for coating wooden or metallic surfaces); dyes or inks (eg. for colouring leather); or solutions of colourings, preservatives or sugar or egg-based materials for use in the food industry. Other possible applications would be the. spraying of fungicides or pesticides in the agricultural industry. The spray gun may be adapted to spray only a single fluid or two or more separate fluids which are then mixed in the spray ejected from the nozzle by the propellant. Thus, certain paints or plastics or other fluids to be sprayed may comprise two or more precursors to be mixed together, ie. the paint itself plus a catalyst or initiator to induce hardening or polymerisation. In the case of paint, an epoxy material is typically pre-mixed with a catalyst to initiate hardening so that the sprayed paint forms a durable layer. Such pre-mixing does, however, suffer from the disadvantage that the pre-mixed paint has only a finite lifetime of use ("pot life") before it sets hard, with consequent wastage of any unused pre-mixed material. With the present invention, it is envisaged that two fluid components may either be pre-mixed to give only a single fluid to be fed into the spray gun, or may be fed independently into the spray gun so that mixing is achieved in situ in the spray ejected from the gun. In an alternative embodiment of in situ mixing, the catalyst or initiator may be mixed in with the propellant so that only a single fluid is sprayed but the propellant provides the necessary second component. The spray gun is preferably configured to spray only a single fluid, and the fluid is preferably paint, especially for use in spraying one or more coatings of paint onto metal or plastic surfaces such as in the automobile industry.

What is claimed:

1. A spray gun having a central axis; a cap with a spray nozzle; a propellant inlet; a propellant valve for controlling delivery of a propellant along a plurality of propellant passages to the spray nozzle, the propellant valve having an open position and a closed position; a fluid valve for controlling delivery of fluid to the spray nozzle; and a common activation member provided on the a the spray gun adapted to control both the propellant valve and the fluid valve; wherein the plurality of propellant passages from the propellant inlet to the cap are substantially linear;

the propellant valve is operable linearly, substantially parallel to the central axis of the spray gun;

the propellant inlet is located forward of the common activation member whereby the propellant valve in the open position provides an unimpeded aperture at the propellant inlet to the plurality of propellant passages; and an adjustment device is provided with the fluid valve to enable adjustment, separately from the propellant valve, of the amount of fluid flowing through the fluid valve, such that in one mode of operation the adjustment device is arranged to maintain the fluid valve closed when the common activation member is operated thereby enabling only propellant to be delivered to the spray nozzle.

2. A spray gun as claimed in claim 1 where the propellant is a gas and the fluid is paint.

3. A spray gun as claimed in claim 1, wherein the propellant valve is located at a propellant inlet and the plurality of propellant passages are substantially parallel to the central axis of the spray gun and axiosymmetric about the central axis.

4. A spray gun as claimed in claim 3, wherein at least one of the plurality of propellant passages is located below a horizontal plane passing through the central axis.

5. A spray gun as claimed in claim 1, wherein the propellant valve is operable linearly, substantially parallel to the common axis of the spray gun whereby the propellant valve in the open position provides an unimpeded aperture at the propellant inlet.

6. A spray gun as claimed in claim 5, wherein the propellant valve includes a valve piston and a valve housing recess that are both tapered whereby when the propellant valve is initially actuated to open, the full periphery of the propellant inlet is immediately unimpeded.

7. A spray gun as claimed in claim 1, wherein the spray gun includes a handle and an ionizer is located within the handle.

8. A spray gun as claimed in claim 7, wherein the spray gun includes a fluid needle valve to permit a mixture of fluid and ionized propellant to be sprayed and wherein an adjustment device is provided for adjustment of the needle valve from zero movement to full movement, without restriction to the movement of the propellant valve, to permit use of the spray gun to blow ionized propellant only prior to a mixture of fluid and ionized propellant being sprayed.

9. A spray gun as claimed in claim 1 wherein the fluid valve is a needle valve aligned with the central axis of the spray gun and the common activation member is in the form of a movable sleeve substantially concentric with the central axis of the spray gun.

10. A spray gun as claimed in claim 1, further including a fluid inlet located immediately adjacent the spray nozzle.

11. A spray gun as claimed in claim 1, further including an ionizer located within the propellant passages between the propellant inlet and the nozzle for ionization of the propellant.

12. A spray gun as claimed in claim 11, werein the ionizer contains a radioactive material.

13. A spray gun having a cap with a spray nozzle and a propellant valve at a propellant inlet for controlling delivery of propellant along a plurality of passages to the cap wherein an ioniser containing a radioactive material for ionising propellant passing through the ioniser is provided adjacent the propellant inlet and the plurality of passages from the propellant inlet to the cap are substantially linear.

* * * * *